United States Patent [19]

Whitney

[11] Patent Number: 4,691,392

[45] Date of Patent: Sep. 8, 1987

[54] JOINT AND TRIM FOR BATHTUBS AND THE LIKE

[75] Inventor: Thomas H. Whitney, Attica, Mich.

[73] Assignee: Trayco, Inc., Lapeer, Mich.

[21] Appl. No.: 828,170

[22] Filed: Feb. 10, 1986

Related U.S. Application Data

[63] Continuation of Ser. No. 615,890, May 31, 1984, abandoned.

[51] Int. Cl.[4] ..... A47K 3/16

[52] U.S. Cl. ..... 4/595; 52/35; 52/718.1

[58] Field of Search ..... 4/584, 592–595, 4/614; 52/35, 278, 462–472, 718.1

[56] References Cited

U.S. PATENT DOCUMENTS

| | | | |
|---|---|---|---|
| 1,009,483 | 11/1911 | Danver | 4/554 |
| 1,704,105 | 3/1929 | Sauer | 4/538 X |
| 1,738,256 | 12/1929 | Miller | 4/538 X |
| 1,939,115 | 12/1933 | Fritsche | 4/538 X |
| 1,962,784 | 6/1934 | Nelson | 4/595 |
| 2,010,036 | 8/1935 | Sakier | 4/538 X |
| 2,143,034 | 1/1939 | Sakier | 4/538 X |
| 2,890,919 | 6/1959 | Hansen | 52/35 X |
| 3,435,574 | 4/1969 | Hallock | 52/466 X |
| 3,667,177 | 6/1972 | Biela | 52/35 X |
| 3,940,900 | 3/1976 | Russo | 52/465 X |
| 4,062,161 | 12/1977 | Schuback | 52/468 X |
| 4,204,376 | 5/1980 | Calvert | 52/35 X |
| 4,290,154 | 9/1981 | Benjamin | 4/595 X |

*Primary Examiner*—Charles E. Phillips

*Attorney, Agent, or Firm*—Steven L. Permut; Malcolm L. Sutherland; Leon E. Redman

[57] ABSTRACT

A joint for a plastic bathtub includes a tub support member that has two channels. The first receives a flange of the bathtub. The support member has its second channel receiving fasteners which affix the support member to a wall. A trim molding is then snap fitted over the second channel to conceal the fasteners and to provide for an aesthetically appealing joint appearance. End caps have fingers which are received in the second channel and are caulked in place to conceal the open end of the joint.

3 Claims, 7 Drawing Figures

JOINT AND TRIM FOR BATHTUBS AND THE LIKE

This is a continuation of application Ser. No. 615,890, filed May 31, 1984, now abandoned.

TECHNICAL FIELD

This invention relates to joints for supporting bathtubs and more particularly to cosmetically trimmed and joints for plastic bathtubs.

DISCLOSURE INFORMATION

Bathtubs commonly have a flange that hooks onto a bathtub support member which in turn is fastened to a wall. Tile or other sheeting can then conceal the mount. See U.S. Pat. No. 1,939,115 issued to Fritsche on Dec. 12, 1933 and U.S. Pat. No. 1,704,105 issued to Sauer on Mar. 5, 1929 for example of these concealed mounts.

Often a trim molding is connected in a fashion to conceal the joint as shown in U.S. Pat. No. 2,010,036 issued on Aug. 6, 1935 and U.S. Pat. No. 2,143,034 issued on Jan. 10, 1939 to Sakier.

Plastic tubs also can be mounted to a hanger which is concealed by tile walls; e.g., the bathtub disclosed in U.S. Pat. No. 4,290,154 issued to Benjamin on Sept. 22, 1981.

With the advent of inexpensive manufactured housing, expensive tiled or contoured walls are no longer used to conceal bathtub joints. In order to mount a plastic bathtub, screws are passed through holes in an upturned peripheral flange of the tub that secures the tub to the wall. The seam between the flange and wall is caulked. Aluminum trim is then positioned over the upturned flange and is fastened by a different set of screws to the wall.

There are two major problems with this commonly used joint. Firstly, the screw heads in the aluminum trim remain exposed to render an aesthetically undesirable appearance. Secondly, the apertures drilled in the flange of the tub become structural weak points. Excessive stress may cause a crack to emanate from the aperture in the flange and ruin the tub. The excessive stress may occur when the manufactured house is transported from the factory to its property site.

What is needed is a support joint for a plastic bathtub that is adaptable to be used with the straight walls found in manufactured housing. In addition, what is needed is a cosmetic trim to conceal the joint without the need for tiling or plastering over the joint.

SUMMARY OF THE INVENTION

In accordance with one aspect of the invention, a support joint for a bathtub includes a support member having a first channel section for supportingly engaging a flange of a bathtub. The support member further includes an upwardly extending flange that receives fasteners therethrough. The fasteners affix the support member to a wall. The support member also has an interlocking section for connecting trim molding thereto which conceals the support member.

Another aspect of the invention relates to a support member having a lower horizontally extending ledge for seating a horizontal shoulder of the bathtub. A vertical flange upwardly extends from the ledge and a rib extends from the flange at a position spaced above the ledge. The ledge, vertical flange, and rib form the first channel for receiving a vertical flange of the bathtub that extends upwardly from the horizontal shoulder. The vertical flange of the support member has a section extending above the rib for receiving fasteners therethrough which fasten the support member to the wall.

In accordance with another aspect of the invention, a trim molding includes a cosmetic front side and a concealable rear side. The rear side has connectors that interlock with the interlocking section of support member. Preferably, the connectors include two resilient prongs. The trim molding preferably has a resiliently inclined section which extends above the prongs such that when the prongs engage the support member, the section is resiliently flexed by the wall to which the support member is affixed.

Preferably, the interlocking section includes at least one tooth which axially extends along a tap ledge of the support member which lockingly engages one of the prongs of the trim molding. Preferably, the top ledge, rib, and upper extension of the vertical flange forms a second channel which at its longitudinal end receives a mounting finger of a cap member which conceals the exposed axial end of the trim, tub flange, and tub support member.

BRIEF DESCRIPTION OF THE DRAWINGS

Reference now is made to the accompanying drawings in which.

DETAILED DESCRIPTION OF THE PREFERRED EMBODIMENT

Figure 1:
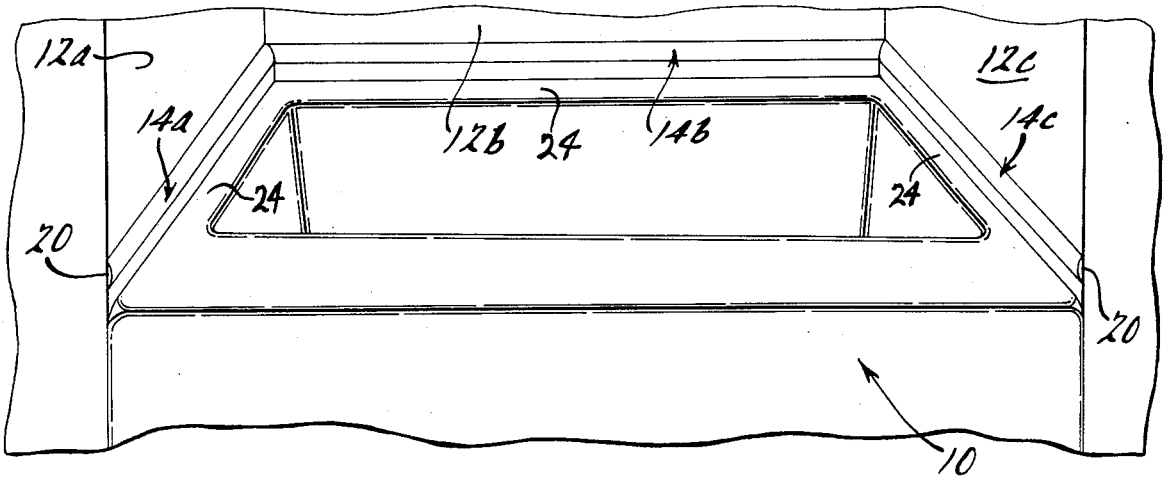
FIG. 1 is a perspective of a tub incorporating the joint and trim according to the invention.

Referring to FIG. 1, a bathtub 10 is mouned to three walls 12*a*, 12*b* and 12*c* by joints 14*a*, 14*b* and 14*c*. The structure of joints 14*a*, *b* and *c* are identical, therefore reference is only made to joint 14*c* unless otherwise specified.

Figure 2:
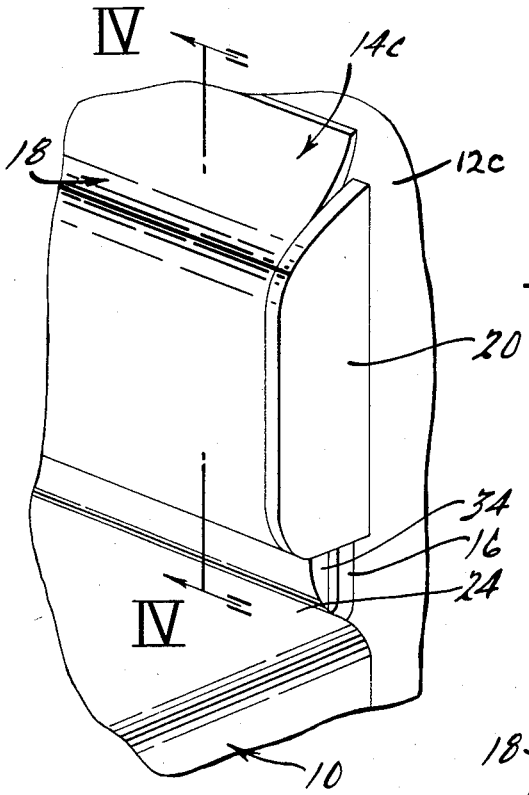
FIG. 2 is an enlarged fragmentary and perspective view showing the trim, tub and end cap according to the invention.
Figure 3:
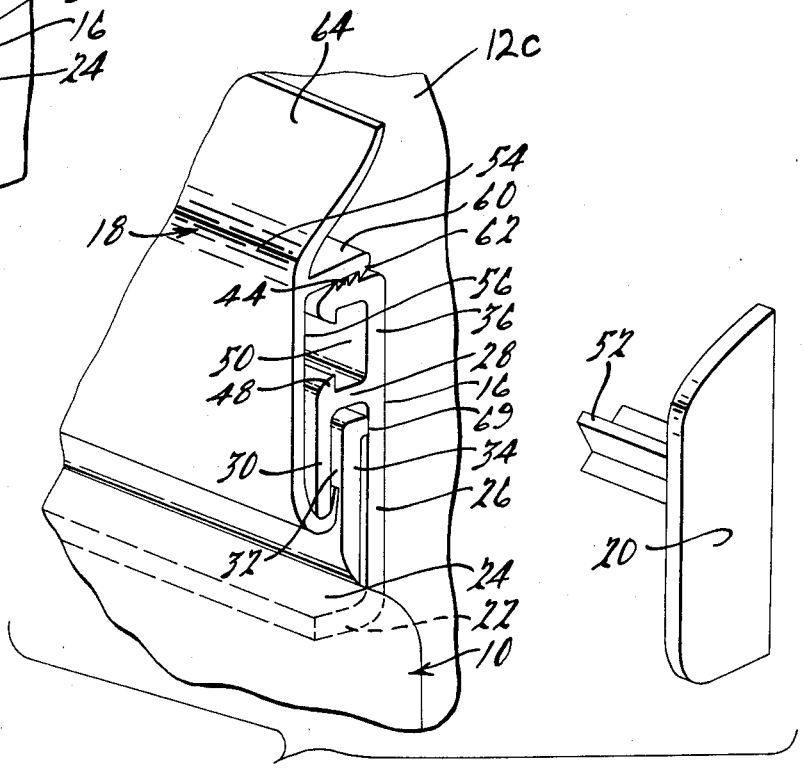
FIG. 3 is a view similar to FIG. 2 with the cap removed to show the support member.

Referring now to FIGS. 2 and 3, the joint 14*c* includes a support 16 and a trim molding 18 interlocked with the support 16. Cap 20 is fitted onto the end of joint 14*c*. All three members, support 16, molding 18 and cap 20 are made from plastic material such as B.F.G. or Ethyl P.V.C.

More specifically, the support 16 as shown in FIGS. 3 through 7 includes a bottom ledge 22 which supports horizontal shoulder 24 of tub 10. Upwardly extending from the bottom ledge 22 is vertical flange 26. Horizontally extending from the vertical flange 26 is a rib 28 which has a downturned rim 30. The ledge 22, flange 26 and rib 28 with its downturned rim 30 forms a channel 32 which receives a flange 34 that upwardly extends from the horizontal peripheral shoulder 24 of tub 10.

The vertical flange 26 extends above the rib 28 to form section 36 for receiving fasteners 40 which secure the support 16 to wall 12*c*. Fasteners 40 tap through section 36 to form apertures 38 therethrough.

A top ledge 42 horizontally extends from section 36. The top surface of ledge 42 has a plurality of saw shaped teeth 44. The ledge 42 also has a lower extending shoulder 46 and rib 28 has an upwardly exending shoulder 48 such that a C-shaped channel 50 is formed. The C-shaped channel is sized to receive and retain a mounting finger 52 of cap 20.

The trim molding 18 includes a cosmetic surface 54 and a rear surface 56. A bottom prong 58 extends from the rear surface and hooks onto the bottom edge of downward extension 30 of rib 28. A second prong 60 has a downwardly extending tooth 62. The prongs 58 and 60 and tooth 62 can extend the entire axial length of molding 18. Tooth 62 resiliently snaps over the saw teeth 44 to lock the trim molding 18 onto the support 16. As shown clearly in FIG. 4, when the trim molding 18 is locked into place. it has an upper resiliently flexible section 64 which flexes against the wall 14*c*.

Figure 6:
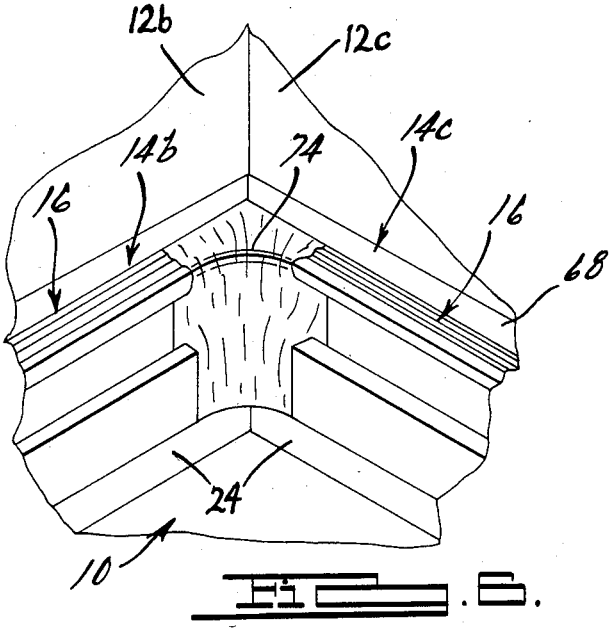
FIG. 6 is a perspective view of a corner of the tub with the trim removed.

Installation of the bathtub 10 to the wall 12*c* is commenced by insertion of the tub flange 34 into the channel 32 and rotating the support 16 such that the bottom ledge 22 slides under the shoulder 24 of the tub 10. Lip 69 at top of flange 34 helps locate the tub flange 34 in the channel 32. The tub 10 is then positioned against the walls and the fasteners 40 are positioned within channel 50 and pass through the section 36 to affix the support 16 onto the wall 12*c*. Caulk bead 68 is then placed along the top ledge 42 and against wall 12*c*. As shown in FIG. 6, the corner 74 between walls 12*b* and 12*c*, (similarly between walls 12*a* and 12*b*) is then filled with caulk to waterproof the gap between the supports 16 and joints 14*b* and 14*c*.

Figure 4:
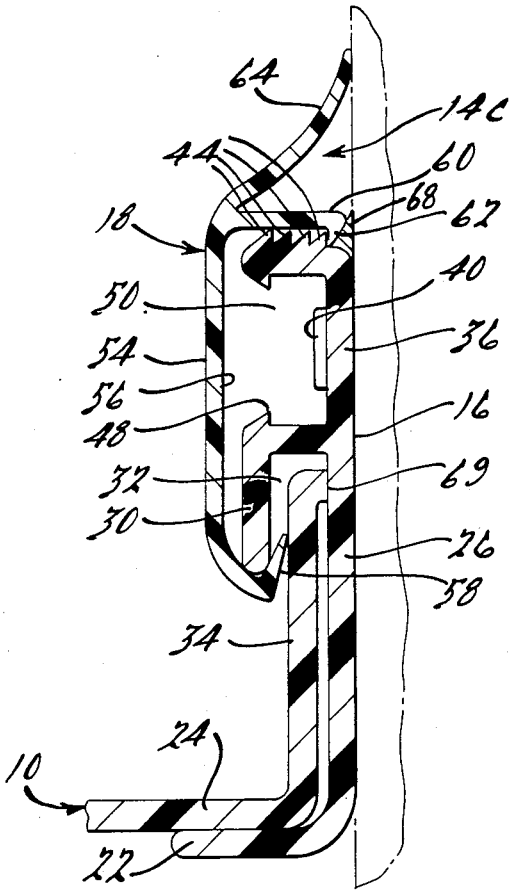
FIG. 4 is a cross-sectional elevational view taken along line IV—IV shown in FIG. 2.
Figure 5:
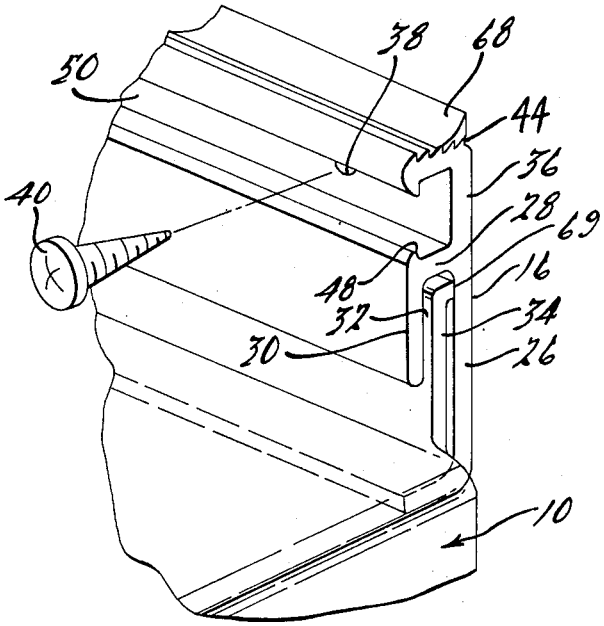
FIG. 5 is a perspective view of the joint with the trim removed.
Figure 7:
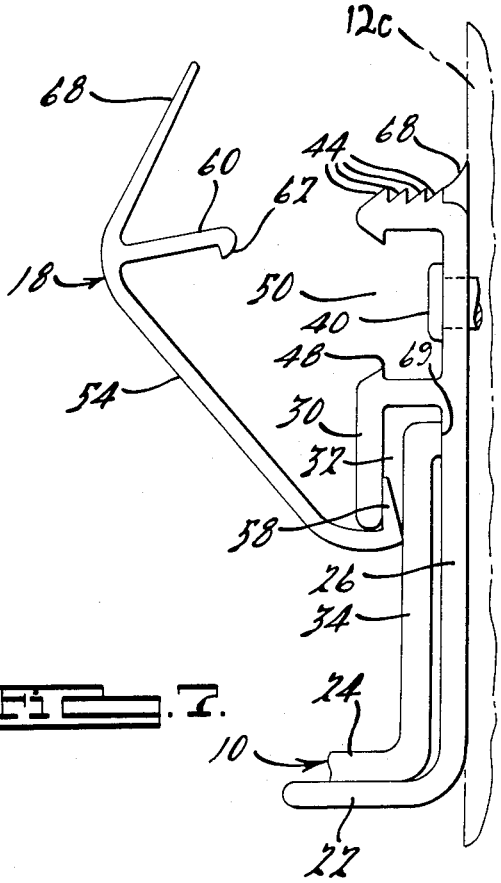
FIG. 7 is a cross-sectional elevational view similar to FIG. 4 showing assembly of the trim onto the hanger member.

The trim molding 18, as shown in FIG. 7, then has its bottom prong 58 engage the bottom edge of rim 30. The trim molding 18 is then pivoted in place until the prong 62 engage the teeth 44 and section 64 abuts the wall 14*c* as shown in FIG. 4. The prong 62 and teeth 44 are shaped such that prong 62 can slide over each tooth 44 to tighten the molding onto the hanger 16 but cannot reverse itself to release from the molding 18. The prongs 62 can engage a choice of teeth 44 depending on the irregularity on curvature of wall 12*c*.

End cap 20 then has its finger 52 inserted within channel 50 and is caulked in place.

In this fashion, a plastic tub can be easily installed without comprising the structural integrity of the plastic tub 10. In addition, the joints 14*a, b* and *c* allow for sufficient flexibility and give such that when a manufactured housing is hauled over the road, the stress encountered during the transport does not cause any structural fatigue or cracks within the tub 10. Furthermore, the trim and joint assembly provides for an easy mounting of the plastic tub and gives an aesthetically desirable appearance to the joints 14*a, b* and *c*.

Variations and modifications of the present invention are possible without departing from its scope and spirit as defined by the appended claims.

The embodiments of the invention in which an exclusive property or privilege is claimed are defined as follows:

1. A support joint for a tub and the like; said joint characterized by:

a support member having an engaging means for supportingly engaging a peripheral flange of a tub;

said support member having an upwardly extending flange that is constructed to be affixed against a wall;

said support member having connector means;

a trim molding member having interlocking means thereon to interconnect with said connector means;

said trim molding having a portion abutting against said wall and concealing said upwardly extending flange of said support member between said wall and said trim molding;

a support member having a lower horizontally extending ledge for seating a horizontal surface of a bathtub;

a vertical flange upwardly exending from said ledge;

a rib extending from said flange spaced above said ledge;

a downturned rim extending downwardly from a free edge of said rib and being spaced from said vertical flange;

said ledge, vertical flange, rib, and rim forming a channel for receiving an upwardly extending flange of said bathtub.

2. A support joint as defined in claim 1 wherein said rib extending from said flange mounts said downwardly turned rim, said downwardly turned rim being said rim of said connector means for engaging one section of said trim molding.

3. A support for a bathtub, said joint characterized by:

a support member having a first channel section for supportingly engaging a flange of a bathtub, and an upwardly extending flange for receiving fasteners therethrough which fasten said support member to a wall; and a connector means on said support member being constructed for snap fittingly connecting a trim molding thereto, said connector means including:

a rim being constructed for securing a first prong of said trim molding;

at least one tooth being constructed for snap fittingly engaging a second prong of said trim molding; and a trim molding having an exposed front surface and concealable rear surface;

said rear surface having spaced apart first and second prongs snap fittingly engageable to said rim and tooth of said connector means on said support member;

a vertical flange upwardly extending from said ledge;

said rib of said connector means extends from said flange;

a downturned rim extending downwardly from a free edge of said rib and being spaced from said vertical flange;

said ledge, vertical flange, rib and rim forming said first channel section for receiving an upwardly extending flange of said bathtub;

said upwardly extending flange extending above said channel section for receiving fasteners therethrough which fasten said support member to said wall.

* * * * *